US005414949A

United States Patent [19]

Peebles

[11] Patent Number: 5,414,949

[45] Date of Patent: May 16, 1995

[54] PORTABLE SHOOTING STAND

[76] Inventor: Kenneth E. Peebles, 17 W. Compton, Brazil, Ind. 47834

[21] Appl. No.: 288,036

[22] Filed: Aug. 10, 1994

[51] Int. Cl.[6] ..... F41A 31/00

[52] U.S. Cl. ..... 42/94; 89/37.04

[58] Field of Search ..... 42/94, 100, 106; 89/37.04

[56] References Cited

U.S. PATENT DOCUMENTS

| | | | |
|---|---|---|---|
| 4,007,554 | 2/1977 | Helmstadter | 42/94 |
| 4,937,965 | 7/1990 | Narvaez | 42/94 |
| 4,967,497 | 11/1990 | Yakscoe | 42/94 |
| 4,972,619 | 11/1990 | Eckert | 42/94 |
| 5,060,410 | 10/1991 | Mueller | 42/94 |
| 5,070,636 | 12/1991 | Mueller | 42/94 |
| 5,149,900 | 9/1992 | Buck | 42/94 |
| 5,173,563 | 12/1992 | Gray | 42/94 |
| 5,220,116 | 6/1993 | Sheets | 42/94 |

*Primary Examiner*—Charles T. Jordan
*Assistant Examiner*—Christopher K. Montgomery
*Attorney, Agent, or Firm*—David L. Baker; Rhodes & Ascolillo

[57] ABSTRACT

An apparatus for supporting a firearm has a base, at least one hinged surface securement member attached to a bottom surface of the base and an extensible firearm support port in the base. An upright locking member is removably placed within the extensible firearm support port. An extensible firearm support is removably connected to the upright locking member. A plurality of seating member ports are in the base and are arranged in symmetrical sets of four. The extensible firearm support has an outer extension tube member and an inner extension tube member slidably, removably and lockingly disposed within the outer extension tube member. The upright locking member is hingedly and removably attached to an end of the outer extension tube member. A firearm stabilization member is removably connected to an end of the inner extension tube member. The inner extension tube member is slidably and releasably locked to the outer extension tube member by a first locking pin. The outer extension tube member may be stored in a stored position by removing an upright locking pin from the upright locking member and placing the pin and the outer extension tube member in the locked stored position. There is an adjustable seat removably attached to the base.

9 Claims, 5 Drawing Sheets

PORTABLE SHOOTING STAND

BACKGROUND OF THE INVENTION

1. Field of the Invention

This invention relates to a portable shooting stand, in general and, in particular, to a portable shooting stand that absorbs some of the recoil of the weapon thus allowing the young and those unable to withstand recoil forces to aim and fire a weapon with greater ease and less apprehension.

2. Description of the Related Art

Many weapon supports have been utilized in the past. But none have addressed the problems encountered by young, elderly and infirm shooters when exposed to repeated recoil trauma. Most of the prior devices are little more than forks in which the weapon is placed. Security of the weapon is enhanced little if at all.

U.S. Pat. No. 4,967,497 to B. J. Yakscoe on Nov. 6, 1990 for an Adjustable and Collapsible Gun and Rifle Support has a vertical support member having two cradles for gun support and an extendible tubular horizontal three-legged base.

U.S. Pat. No. 4,972,619 to K. I. Eckert on Nov. 27, 1990 for a Rifle Sighting Apparatus describes a two-part, separated base. The first part of the base is hinged and adjustable to raise or lower the forward portion of the weapon. The second part cradles the butt of the weapon.

U.S. Pat. No. 5,060,410 to E. Mueller on Oct. 29, 1991 for a Collapsible Shooting Stand shows a seating assembly that collapses for transport. The seat and the weapon clamp support pivot on a common axis. The weapon is clamped onto the weapon support.

U.S. Pat. No. 5,070,636 to E. Mueller on Dec. 10, 1991 for a Gun Sighting Device describes a slotted base slidingly and adjustably engaged by a weapon holding cradle to allow the use of varying length weapons. The weapon is bungie-corded into the cradle for security.

U.S. Pat. No. 5,220,116 to J. R. Sheets on Jun. 15, 1993 for a Shooting Platform for Quadriplegics describes a frame attached to a turntable. A wheelchair sits on the turntable. As the turntable is rotated, the user can adjust the height of the weapon, aim and fire the weapon. The trigger mechanism is connected to an assembly that allows the user to fire the weapon by using only the palm of his hand.

The present portable shooting stand is constructed to reduce painful trauma resulting from recoil while providing a comfortable, stable shooting position. The weapon is held securely in place and the user may aim at multiple points with minimum difficulty.

SUMMARY OF THE INVENTION

The present invention is a stand which supports the barrel of a weapon to reduce the recoil that is produced when the weapon is fired. It is intended for children and adults who, either due to their age or strength or physical impairment, are unable to cope with the large recoil forces produced by some weapons. The stand also enables the young, elderly and infirm individuals to aim the weapon if their strength or infirmities prohibit a steady aim without support. Reduction in trauma due to recoil is accomplished by having the weapon releasably secured in the cradle by a hook and loop strap which snugs the weapon into a resilient protective pad which also serves an additional function of gripping and retaining the weapon.

The vertical weapon support is height adjustable and the cradle pivots on the support thus allowing infinite sighting ability. The support also unlocks from its upright position and locks down into a transport and storage position merely by pulling and replacing a locking pin. The stand has a pivotable seat which can be adjusted for seat height by removing a lock pin and aligning the adjustment port and placing the pin back in the new position. The support and the seating member are also easily disassembled. There are barbed securing arms hingedly attached to the bottom surface of the base of the stand to stabilize the positioning of the stand on penetrable earth.

In one aspect of the present invention, an apparatus for supporting a firearm is described that has a base, at least one hinged surface securement member attached to a bottom of the base and an extensible firearm support port extending through or into the base. An upright locking member is removably placed within the extensible firearm support port. There is an extensible firearm support removably connected to the upright locking member. A plurality of seating member ports extend through or into the base and are arranged in symmetrical sets of four.

The extensible firearm support has an outer extension tube member. There is an inner extension tube member slidably, removably and lockingly disposed within the outer extension tube member. The upright locking member is hingedly and removably attached to an end of the outer extension tube member. A firearm stabilization member is removably connected to an end of the inner extension tube member. There is a plurality of inner adjustment ports in the inner extension tube member and a plurality of outer adjustment ports in the outer extension tube member. A first locking pin removably extends through the inner adjustment ports and through the outer adjustment ports when one of the inner adjustment ports is aligned with one of the outer adjustment ports. There is a first set of upright locking ports and a second set of upright locking ports in the upright locking member.

In another aspect of the present invention, an apparatus for supporting a firearm is described that has a base. There is at least one hinged surface securement member attached to a bottom surface of the base.

An extensible firearm support port extends through or into the base. The extensible firearm support port has an outer extension tube member and an inner extension tube member that is slidably, removably and lockingly disposed within the outer extension tube member. There is a plurality of seating member ports extending through or into the base and the seating member ports are arranged in symmetrical sets of four.

The upright locking member is hingedly and removably attached to an end of the outer extension tube member. A firearm stabilization member is removably connected to an end of the inner extension tube member. There is a plurality of inner adjustment ports in the inner extension tube member and a plurality of outer adjustment ports in the outer extension tube member. A first locking pin removably extends through the inner adjustment ports and extends through the outer adjustment ports when one of the inner adjustment ports is aligned with one of the outer adjustment ports.

An upright locking member is removably placed within the extensible firearm support port. There is a first set of upright locking ports in the upright locking member. There is also a second set of upright locking ports in the upright locking member. An extensible firearm support is removably connected to the upright locking member. The extensible firearm support has a second locking pin removably extending through one of the outer adjustment ports and removably extending through the first set upright locking ports. A third locking pin removably extends through the second set of upright locking ports when the outer extension tube member and the inner extension tube member are in an upright position. This locks the outer extension tube member and the inner extension tube member in an upright position. The third locking pin removably extends through one of the outer adjustment ports and extends through the second set of upright locking ports, when the second set of upright locking ports is aligned with one of the outer adjustment ports when the outer extension tube member and the inner extension tube member are in a storage position.

The firearm stabilization member has a cradle support tube removably connected to the one end of the inner extension tube member. There is a cradle pivotally connected to the cradle support tube and a releasable firearm securing apparatus attached to the cradle. A firearm protective surface is connected to an inside surface of the cradle.

There is a seating member removably attached to selected seating member ports. The seating member has an outer seat extension tube member and an inner seat extension tube member slidably, removably and lockingly disposed within the outer seat extension tube member. There is a plurality of seat base securing arms. Each seat base securing arm has one end connected to the outer seat extension tube member and each seat base securing arm has another end removably placed within one of the seating member ports. There is a plurality of inner seat adjustment ports in the inner seat extension tube member and a plurality of outer seat adjustment ports in the outer seat extension tube member. A seat is pivotally and removably attached to one end of the inner seat extension tube member.

In yet another aspect of the present invention to be clamped to a bench or tabletop, an apparatus for supporting a firearm is shown (see FIG. 5) and described that has a base 11 and a base securing member 48 attached to the base. The base securing member 48 shown in FIG. 5 is a bifurcated arm assembly 49 that has a plurality of teeth 50 on a bottom arm 51 and threaded securing members 52 threadingly attached to an upper arm 53 that when threaded toward a table or bench top will cause the teeth to grip the top and hold the base in place. Parts similar to the preferred embodiment have similar reference numbers.

There is an extensible firearm support, connected to the base. The extensible firearm support has an outer extension tube member and an inner extension tube member slidably, removably and lockingly disposed within the outer extension tube member. A firearm stabilization member is removably connected to an end of the inner extension tube member. There is a plurality of inner adjustment ports in the inner extension tube member and there is at least one outer adjustment port in the outer extension tube member. A first locking pin removably extends through the inner adjustment ports and through the outer adjustment ports when one of the inner adjustment ports is aligned with one of the outer adjustment ports. The firearm stabilization member also has a cradle support tube that is removably connected to the one end of the inner extension tube member. There is a cradle pivotally connected to the cradle support tube. A releasable firearm securing apparatus is attached to the cradle and a firearm protective surface is connected to an inside surface of the cradle.

It is an object of this invention to provide a shooting stand, to absorb the recoil resulting from a weapon being fired, to ease the shock upon the shoulder of a young child or an infirm or elderly adult.

It is another object of this invention to provide a means to stabilize the base of the stand for more accurate firing.

It is yet another object of this invention to provide a shooting stand that may be disassembled and stored for transportation and storage.

DESCRIPTION OF THE PREFERRED EMBODIMENT

Figure 1:
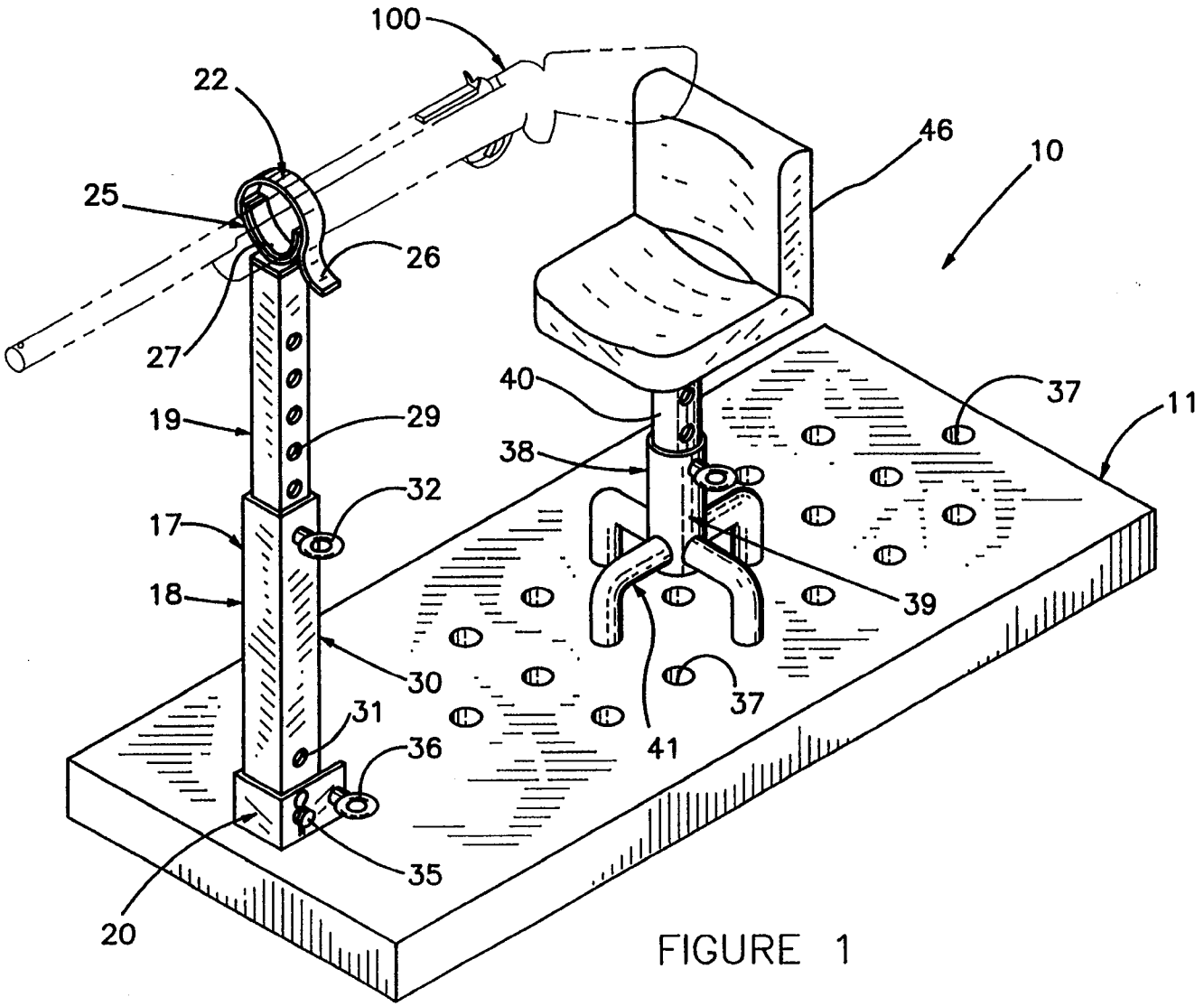
FIG. 1 is a perspective view of the Portable Shooting Stand showing a weapon mounted in the cradle.
Figure 2:
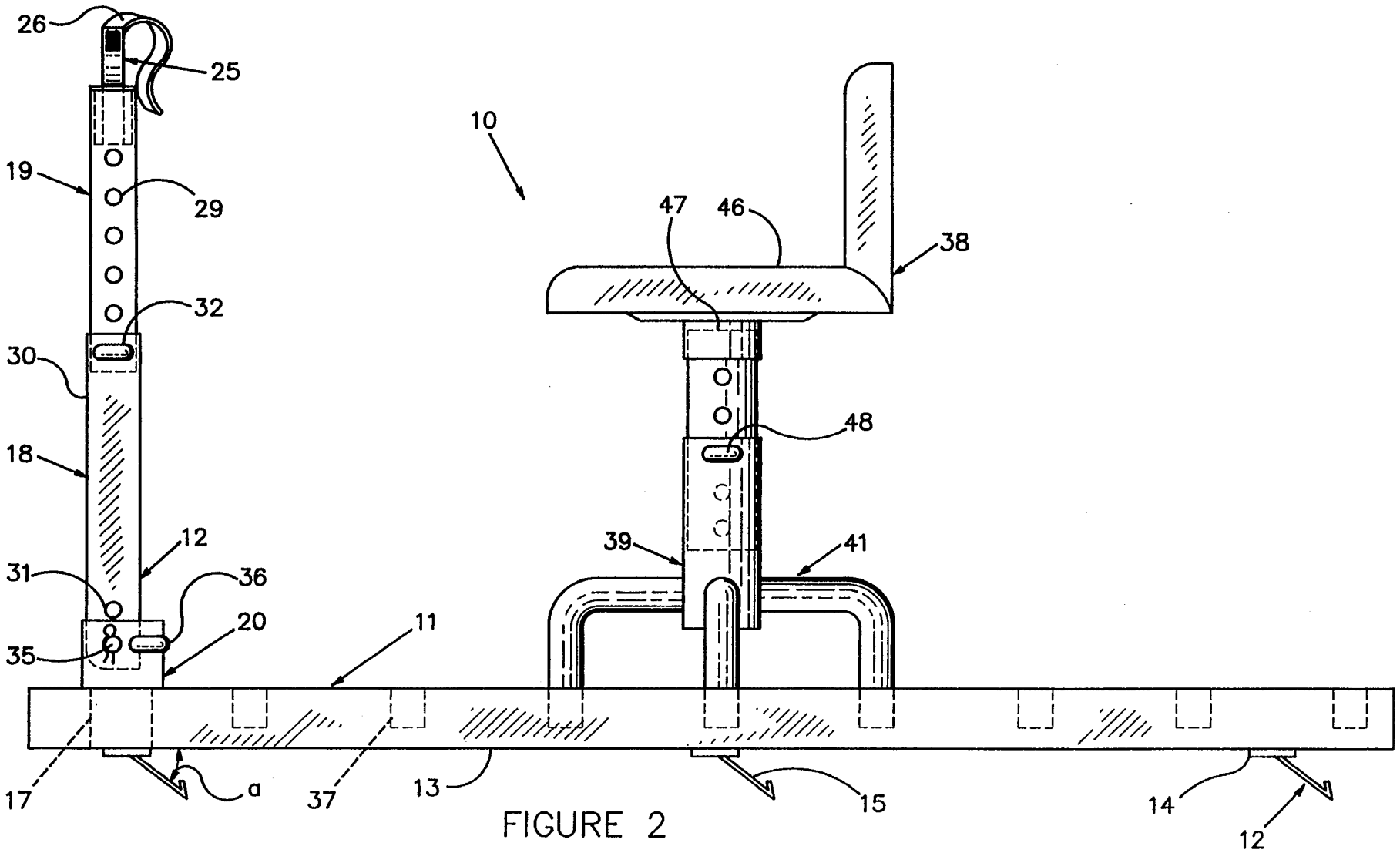
FIG. 2 is a left side elevational view with several hidden lines to show various features.
Figure 3:
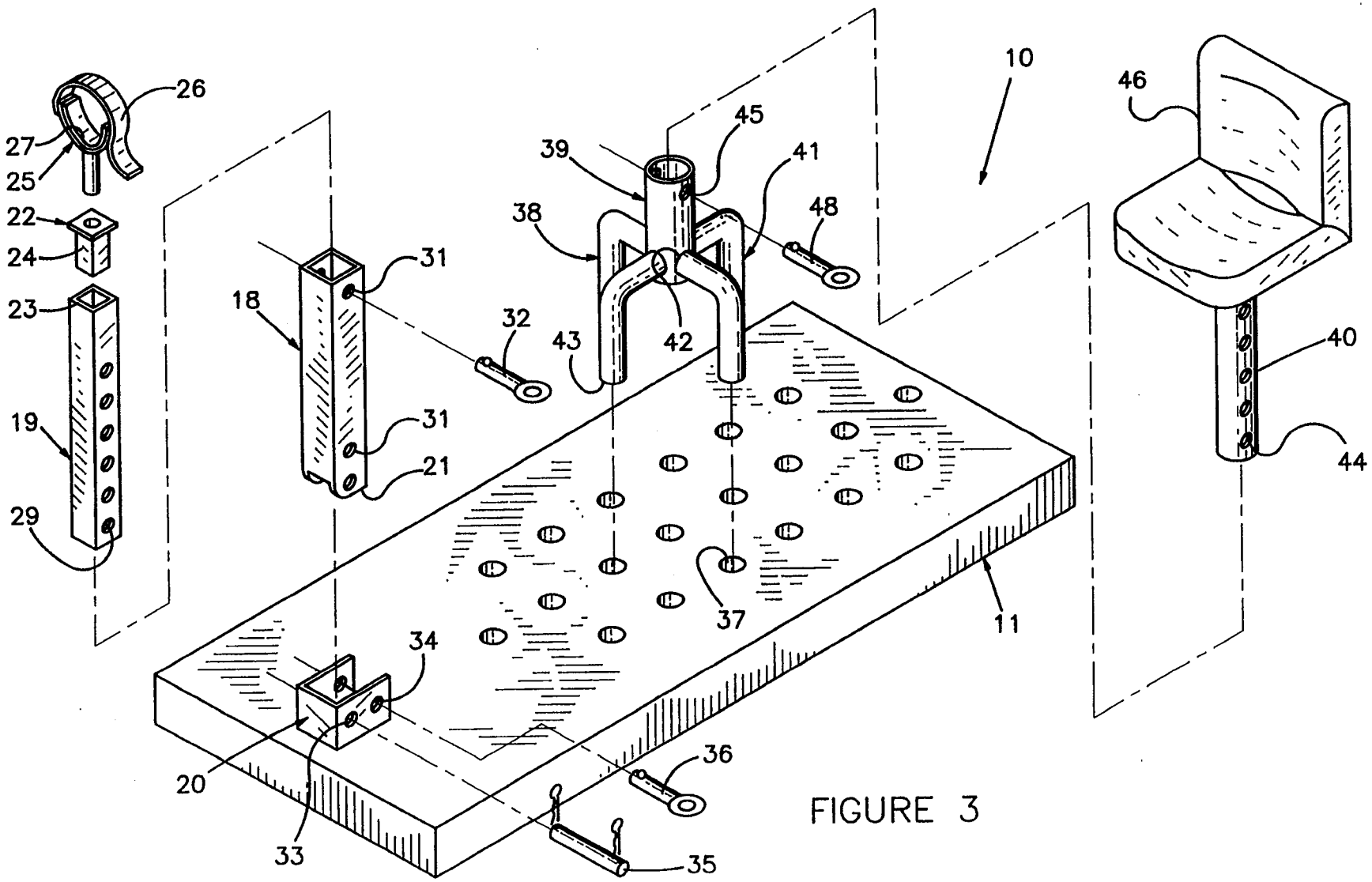
FIG. 3 is an exploded perspective view.
Figure 4:
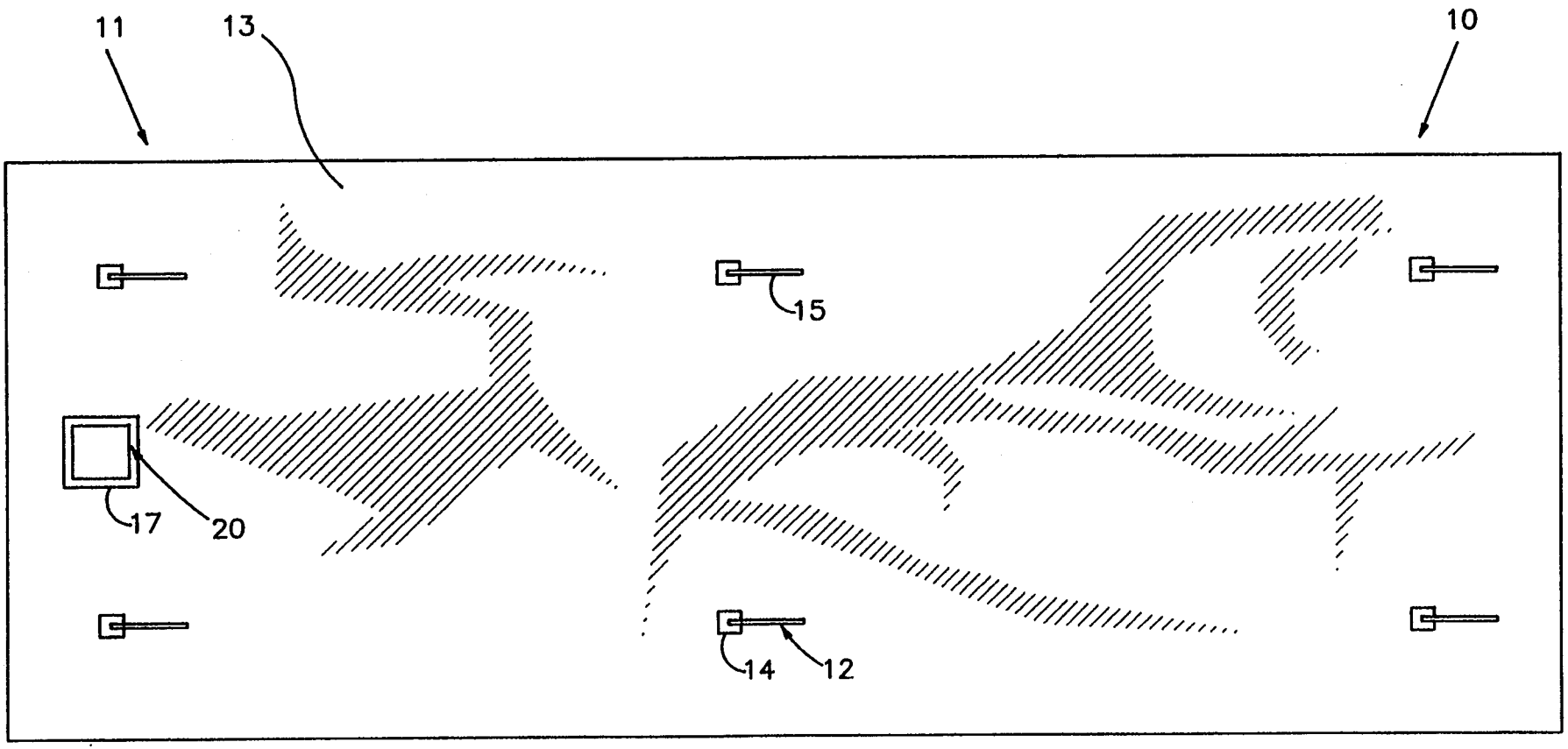
FIG. 4 is a bottom plan view.
Figure 6:
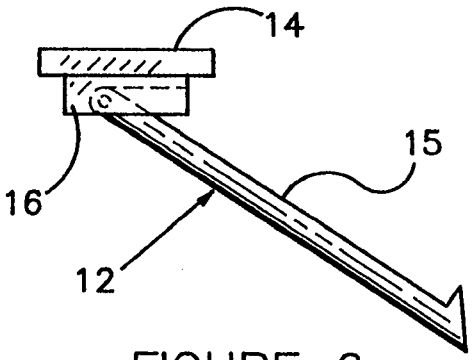
FIG. 6 is a right side elevational view of the hinged surface securement member in its extended position.
Figure 7:
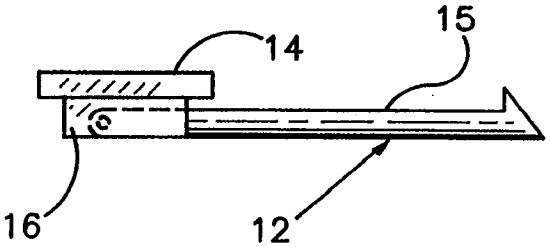
FIG. 7 is a right side elevational view of the hinged surface securement member in its folded position.
Figure 5:
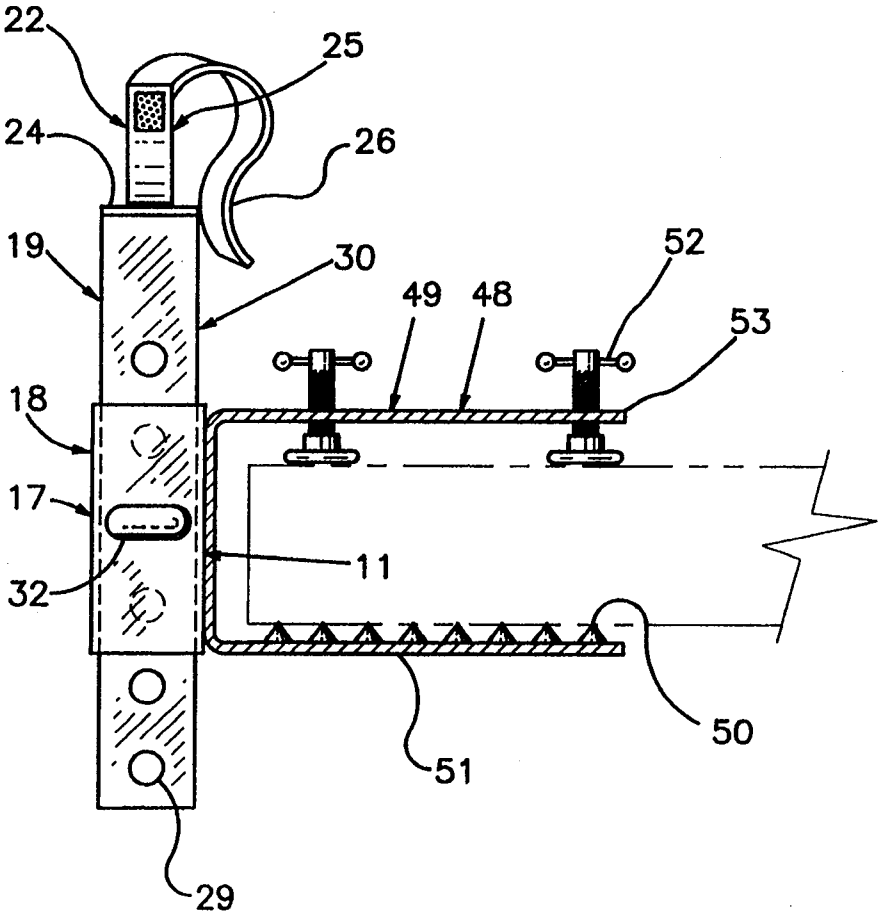
FIG. 5 is a left side elevational view of an alternative embodiment of the Portable Shooting Platform that can be clamped onto a table edge.

Referring to FIGS. 1 through 7, an apparatus 10 for supporting a firearm 100 is shown and described that has a base 11 and at least one hinged surface securement member 12 attached to a bottom surface 13 of the base 11. The hinged surface securement member 12 has a securement plate 14 secured to the bottom surface 13 of the base 11 and an arm 15 that folds down to a preselected angle "a". The degree of angle "a" is governed by an arm stop member 16 attached to the securement plate 14. When the arm 15 abuts arm stop member 16, the arm is in its fully extended position and ready to pierce the ground to reduce the movement of the base 11 once the base is set in place on the ground.

There is an extensible firearm support port 17, extending through or into the base 11. There is an extensible firearm support 30, removably connected to an upright locking member 20. The extensible firearm support 30 has an outer extension tube member 18 and an inner extension tube member 19 slidably, removably and lockingly disposed within the outer extension tube member 18. The upright locking member 20 is hingedly and removably attached to an end 21 of the outer extension tube member 18. There is a firearm stabilization member 22 removably connected to an end 23 of the inner extension tube member 19. The firearm stabilization member 22 has a cradle support tube 24 that is removably connected to the end 23 of the inner extension tube member 19. A cradle 25 is pivotally connected to the cradle support tube 24 and a releasable firearm securing apparatus 26 (preferably a hook and loop fastener) is attached to the cradle 25. There is a firearm protective surface 27 connected to an inside surface (not shown, covered by 27) of the cradle 25. The upright locking member 20 is removably placed within the extensible firearm support port 17. The extensible firearm support 30 is removably connected to the upright locking member 20.

There is a plurality of inner adjustment ports 29 in the inner extension tube member 19 and a plurality of outer adjustment ports 31 in the outer extension tube member 18. A first locking pin 32 removably extends through the inner adjustment ports 29 and through the outer adjustment ports 31 when one of the inner adjustment ports 29 is aligned with one of the outer adjustment ports 31. There is a first set of upright locking ports 33 and a second set of upright locking ports 34 in the upright locking member 20. A second locking pin 35 removably extends through one of the outer adjustment ports 31 and extends through the first set of upright locking ports 33. A third locking pin 36 removably extends through the second set of upright locking ports 34 when the outer extension tube member 18 and the inner extension tube member 19 are in an upright position. This locks the outer extension tube member 18 and the inner extension tube member 19 in an upright position. The third locking pin 36 removably extends through one of the outer adjustment ports 31 and extends through the second set of upright locking ports 34 when the second set of upright locking ports 34 is aligned with one of the outer adjustment ports 31 when the outer extension tube member 18 and the inner extension tube member 19 are in a storage position (not shown).

There is a plurality of seating member ports 37 extending through or into the base 11. The seating member ports 37 are arranged in symmetrical sets of four (see FIG. 1) and a seating member 38 is removably attached to selected seating member ports 37. The seating member 38 has an outer seat extension tube member 39 and an inner seat extension tube member 40 slidably, removably and lockingly disposed within the outer seat extension tube member 39. There is a plurality of seat base securing arms 41. Each of the seat base securing arms 41 has one end 42 connected to the outer seat extension tube member 39 and each seat base securing arm has another end 43 removably placed within one of the seating member ports 37. There is a plurality of inner seat adjustment ports 44 in the inner seat extension tube member 40 and a plurality of outer seat adjustment ports 45 in the outer seat extension tube member 39. A seat 46 is pivotally and removably attached to one end 47 of the inner seat extension tube member 40. The seating member 38 has a seat locking pin 48 that removably extends through the inner seat adjustment ports 44 and through the outer seat adjustment ports 45 when one of the inner seat adjustment ports 44 is aligned with one of the outer seat adjustment ports 45.

In operation, the user folds down the barbed hinged surface securement member 12 attached to a bottom surface 13 of the base 11 and places the base in the desired position at the firing area working the barbed arms into the earth if desired. The extensible firearm support 30 is unlocked from the stored position by removing the third locking pin 36. The extensible firearm support 30 is locked into the upright firing position by placing the third pin into the second set of upright locking ports when the extensible firearm support 30 is in the upright position. The seat base securing arms 41 are then placed within the seating member ports 37 at a desired positions; The weapon 100 is then placed into the cradle 25, as shown in FIG. 1, and secured by the hook and loop fastener strap 26. The elevation of the weapon is adjusted by raising or lowering the inner extension tube 19 and then securing the inner extension tube to the outer extension tube 18 by placing the first locking pin 32 into a preselected set of inner adjustment ports 29 and outer adjustment ports 31. The weapon can then be pivoted by way of the cradle support tube 22 while secured in the cradle 25. The cradle 25 pivots in the cradle support tube 22. Seat height preference can be adjusted by raising or lowering the inner seat extension tube member 40 which is slidably, removably and lockingly disposed within the outer seat extension tube member 39. The user just removes the seat locking pin 48, selects and aligns the desired inner and outer seat adjustment ports and reinserts the seat locking pin. The seat 46 pivots on the top end 47 of the inner seat extension tube member 40. After use, the portable shooting stand 10 is easily disassembled.

The foregoing descriptions and drawings of the invention are explanatory and illustrative only, and changes in shape, sizes and arrangements of parts as well certain details of the illustrated construction may be made within the scope of the appended claims without departing from the true spirit of the invention.

I claim:

1. An apparatus for supporting a firearm comprising:

(a) a base;

(b) at least one hinged surface securement member attached to a bottom surface of the base;

(c) an extensible firearm support port in the base;

(d) an upright locking member removably placed within the extensible firearm support port;

(e) an extensible firearm support removably connected to the upright locking member;

(f) a plurality of seating member ports in the base; and (g) the seating member ports being arranged in symmetrical sets of four.

2. An apparatus for supporting a firearm as described in claim 1 wherein the extensible firearm support further comprises:

(a) an outer extension tube member;

(b) an inner extension tube member slidably, removably and lockingly disposed within the outer extension tube member;

(c) the upright locking member hingedly and removably attached to an end of the outer extension tube member;

(d) a firearm stabilization member removably connected to an end of the inner extension tube member;

(e) a plurality of inner adjustment ports in the inner extension tube member;

(f) a plurality of outer adjustment ports in the outer extension tube member;

(g) a first locking pin removably extending through the inner adjustment ports and through the outer adjustment ports when one of the inner adjustment ports is aligned with one of the outer adjustment ports;

(h) a first set of upright locking ports in the upright locking member; and (i) a second set of upright locking ports in the upright locking member.

3. An apparatus for supporting a firearm comprising:

(a) a base;

(b) at least one hinged surface securement member attached to a bottom surface of the base;

(c) an extensible firearm support port in the base;

(d) an upright locking member removably placed within the extensible firearm support port;

(e) an extensible firearm support, removably connected to the upright locking member, comprising:

an outer extension tube member;

an inner extension tube member slidably, removably and lockingly disposed within the outer extension tube member;

the upright locking member hingedly and removably attached to an end of the outer extension tube member;

a firearm stabilization member removably connected to an end of the inner extension tube member;

a plurality of inner adjustment ports in the inner extension tube member;

a plurality of outer adjustment ports in the outer extension tube member;

a first locking pin removably extending through the inner adjustment ports and through the outer adjustment ports when one of the inner adjustment ports is aligned with one of the outer adjustment ports;

a first set of upright locking ports in the upright locking member; and a second set of upright locking ports in the upright locking member;

(f) a plurality of seating member ports in the base; and (g) the seating member ports being arranged in symmetrical sets of four.

4. An apparatus for supporting a firearm as described in claim 3 wherein the extensible firearm support further comprises:

(a) a second locking pin removably extending through one of the outer adjustment ports and extending through the first set of upright locking ports; and (b) a third locking pin removably extending through a second set of upright locking ports when the outer extension tube member and the inner extension tube member are in an upright position; and (c) the third locking pin removably extending through one of the outer adjustment ports and extending through the second set of upright locking ports when the second set of upright locking ports is aligned with one of the outer adjustment ports when the outer extension tube member and the inner extension tube member are in a storage position.

5. An apparatus for supporting a firearm as described in claim 3 wherein the firearm stabilization member further comprises:

(a) a cradle support tube removably connected to the one end of the inner extension tube member;

(b) a cradle pivotally connected to the cradle support tube;

(c) a releasable firearm securing apparatus attached to the cradle; and (d) a firearm protective surface connected to an inside surface of the cradle.

6. An apparatus for supporting a firearm as described in claim 3 further comprising a seating member removably attached to selected seating member ports.

7. An apparatus for supporting a firearm as described in claim 6 wherein the seating member further comprises:

(a) an outer seat extension tube member;

(b) an inner seat extension tube member slidably, removably and lockingly disposed within the outer seat extension tube member;

(c) a plurality of seat base securing arms each having one end connected to the outer seat extension tube member and each having another end removably placed within one of the seating member ports;

(d) a plurality of inner seat adjustment ports in the inner seat extension tube member;

(e) a plurality of outer seat adjustment ports in the outer seat extension tube member; and (f) a seat pivotally and removably attached to one end of the inner seat extension tube member.

8. An apparatus for supporting a firearm comprising:

(a) a base;

(b) at least one hinged surface securement member attached to a bottom surface of the base;

(c) an extensible firearm support port in the base;

(d) an upright locking member removably placed within the extensible firearm support port;

(e) an extensible firearm support, removably connected to the upright locking member, comprising:

an outer extension tube member;

an inner extension tube member slidably, removably and lockingly disposed within the outer extension tube member;

the upright locking member hingedly and removably attached to an end of the outer extension tube member;

a firearm stabilization member removably connected to an end of the inner extension tube member comprising:

a cradle support tube removably connected to the one end of the inner extension tube member;

a cradle pivotally connected to the cradle support tube;

a releasable firearm securing apparatus attached to the cradle;

a firearm protective surface connected to an inside surface of the cradle;

a plurality of inner adjustment ports in the inner extension tube member;

a plurality of outer adjustment ports in the outer extension tube member;

a first locking pin removably extending through the inner adjustment ports and through the outer adjustment ports when one of the inner adjustment ports is aligned with one of the outer adjustment ports;

a first set of upright locking ports in the upright locking member;

a second set of upright locking ports in the upright locking member;

a second locking pin removably extending through one of the outer adjustment ports and extending through the first set of upright locking ports;

a third locking pin removably extending through a second set of upright locking ports when the outer extension tube member and the inner extension tube member are in an upright position; and the third locking pin removably extending through one of the outer adjustment ports and extending through the second set of upright locking ports when the second set of upright locking ports is aligned with one of the outer adjustment ports when the outer extension tube member and the inner extension tube member are in a storage position;

(f) a plurality of seating member ports in the base;

(g) the seating member ports being arranged in symmetrical sets of four; and (h) a seating member removably attached to selected seating member ports comprising:

an outer seat extension tube member;

an inner seat extension tube member slidably, removably and lockingly disposed within the outer seat extension tube member;

a plurality of seat base securing arms each having one end connected to the outer seat extension tube member and each having another end removably placed within one of the seating member ports;

a plurality of inner seat adjustment ports in the inner seat extension tube member;

a plurality of outer seat adjustment ports in the outer seat extension tube member; and a seat pivotally and removably attached to one end of the inner seat extension tube member.

9. An apparatus for supporting a firearm as described in claim 8 wherein the seating member further comprises a seat locking pin removably extending through the inner seat adjustment ports and through the outer seat adjustment ports when one of the inner seat adjustment ports is aligned with one of the outer seat adjustment ports.

* * * * *